US007414356B2

(12) United States Patent
Yamamoto et al.

(10) Patent No.: US 7,414,356 B2
(45) Date of Patent: Aug. 19, 2008

(54) CATHODE STRUCTURE INCLUDING BARRIER FOR PREVENTING METAL BRIDGING FROM HEATER TO EMITTER

(75) Inventors: Yoji Yamamoto, Nishinomiya (JP); Mika Yamagishi, Takatsuki (JP); Satoru Nakagawa, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 317 days.

(21) Appl. No.: 10/755,528

(22) Filed: Jan. 12, 2004

(65) Prior Publication Data

US 2004/0207307 A1 Oct. 21, 2004

(30) Foreign Application Priority Data

Jan. 17, 2003 (JP) ..... 2003-009749

(51) Int. Cl.
*H01J 1/24* (2006.01)
*H01J 19/18* (2006.01)
*H01J 19/10* (2006.01)
*H01J 19/48* (2006.01)

(52) U.S. Cl. ..... 313/340; 313/346 R; 313/337; 313/270; 313/37

(58) Field of Classification Search ..... 313/340, 313/446, 270–271, 346 DC, 341, 344–345, 313/346 R, 337, 37
See application file for complete search history.

(56) References Cited

U.S. PATENT DOCUMENTS

| | | | | | |
|---|---|---|---|---|---|
| 2,899,591 | A * | 8/1959 | Stein | 313/337 |
| 3,056,900 | A * | 10/1962 | Tyson | 313/346 R |
| 3,175,118 | A * | 3/1965 | Ney | 313/340 |
| 3,652,894 | A * | 3/1972 | Held | 313/340 |
| 3,671,792 | A * | 6/1972 | Waltermire | 313/337 |
| 3,745,403 | A * | 7/1973 | Misumi | 313/341 |
| 5,065,070 | A * | 11/1991 | Longo et al. | 313/346 DC |
| 5,105,456 | A * | 4/1992 | Rand et al. | 378/125 |
| 5,451,831 | A * | 9/1995 | Lee | 313/346 R |
| 6,130,502 | A * | 10/2000 | Kobayashi et al. | 313/446 |
| 6,300,711 | B1 * | 10/2001 | Yamamoto et al. | 313/337 |
| 6,552,479 | B2 * | 4/2003 | Komiya et al. | 313/337 |
| 6,771,014 | B2 * | 8/2004 | Longo et al. | 313/346 DC |
| 6,946,781 | B2 * | 9/2005 | Ricaud | 313/310 |

FOREIGN PATENT DOCUMENTS

GB 2296371 A * 6/1996

* cited by examiner

*Primary Examiner*—Nimeshkumar Patel
*Assistant Examiner*—Anne M Hines

(57) ABSTRACT

A cathode structure comprises a heater including a columnar ceramic body and a heating wire that is partially buried in the ceramic body, and a cathode unit disposed at a first end surface of the ceramic body. The heating wire leads out from a second end surface of the ceramic body.

24 Claims, 14 Drawing Sheets

CATHODE STRUCTURE INCLUDING BARRIER FOR PREVENTING METAL BRIDGING FROM HEATER TO EMITTER

This application is based on application No. 2003-9749 filed in Japan, the content of which is hereby incorporated by reference.

BACKGROUND OF THE INVENTION (1) Field of the Invention

The present invention relates to a cathode structure, an electron gun including the cathode structure, and a cathode ray tube including the electron gun.

(2) Description of the Related Art

A cathode structure is a component of an electron gun that is included in a cathode ray tube, and it is desired that the cathode structure is made as short as possible in a direction of a tube axis in order to reduce a size of the electron gun in the direction of the tube axis and the cathode ray tube that includes the electron gun. In terms of power consumption, it is also desirable that a heater for heating an electron-emitting material may be heated up as efficiently as possible.

An example of such cathode structures is disclosed in Japanese Laid-Open Patent Application No. 2001-202898, and a perspective view thereof is illustrated in FIG. 1A.

As shown in FIG. 1A, a cathode structure 202 comprises a cylindrical metal cup 204, a circular columnar pellet 206 incorporated in the metal cup 204, and a circular columnar heater 208. The metal cup 204 and the heater 208 are combined in a manner such that supporting metal wires 210 and 212 are positioned so as to cross each other between the metal cup 204 and the heater 208.

The pellet 206 is made of a porous refractory material impregnated with an electron-emitting material primarily composed of barium oxide (BaO). When the pellet 206 is heated by the heater 208, thermal electrons are emitted from an exposed surface of the pellet 206. The supporting metal wires 210 and 212 are used as lead wires when applying a cathode voltage and an image signal voltage to the pellet 206, as well as supporting the cathode structure 202 in the electron gun.

The cathode structure 202 as described above is held in a position where a center axis of the circular columnar pellet 206 is roughly in parallel with a tube axis (Z axis) of the cathode ray tube.

FIG. 1B is a cross-sectional view of the heater 208, in which the heater 208 is cross-sectioned with a plane that is perpendicular to the tube axial direction. As shown in the drawing, the heater 208 is made of a ceramic (electric insulating material) body 216 in which a heating wire 214 is partially buried. In an example given here, the heating wire 214 in the ceramic body 216 includes three coiled parts that are connected in series. Leading parts 214B are both ends of the heating wire that are extending from the ceramic body.

In the above cathode structure, the coiled parts are buried so that a lengthwise direction of each coiled part becomes perpendicular with the Z axis. Accordingly, in comparison with a common cathode structure in which the lengthwise direction of the coiled part is in parallel with the Z axis, it is possible to reduce the size of the cathode structure in the tube axial direction. In addition, in a case of the common cathode structure, heating efficiency of the electron-emitting material varies in the lengthwise direction of the coil, because distances to the electron-emitting material from one end of the coil and that from the other end of the coil are different. However, in a case of the cathode structure 202 illustrated in FIGS. 1A and 1B, it is possible to heat the electron-emitting material evenly in the lengthwise direction.

However, inventors of the present invention found that, when the cathode structure 202 illustrated in FIGS. 1A and 1B is used for an extended period of time, it often happens that an amount of electron beam cannot be controlled by the cathode voltage or the image signal voltage.

The inventors of the present invention also found out that barium (Ba) evaporated from the pellet 206 when heated causes the above problem. Specifically, the evaporated barium accumulates on a side surface of the circular columnar ceramic body 216 and such, and eventually causes a short-circuit between the leading parts 214B of the heating wire 214 and the metal cup 204 of the pellet 206. As a result, a relative potential difference between a G1 electrode (control electrode) and a cathode (pellet) corresponding to the cathode voltage and the image signal voltage cannot be obtained, and the amount of electron beam cannot be controlled.

In addition, a temperature at a part, which is just exposed from the ceramic body 216, of the leading parts 214B of the heating wire 214 becomes as high as the coiled part buried in the ceramic body 216 when operating. Accordingly, unnecessary thermal electrons are emitted as a result of an influence of the accumulated barium, independently of the cathode voltage and the image signal voltage.

SUMMARY OF THE INVENTION

A first object of the present invention is to provide a cathode structure with which the above stated problem is not easily caused even when the cathode structure is used for an extended period of time.

A second object of the present invention is to provide an electron gun including such a cathode structure.

A third object of the present invention is to provide a cathode ray tube including such an electron gun.

The first object of the present invention is achieved by a cathode structure comprising a heater including a columnar electric insulating material body and a heating wire that is partially buried in the electric insulating material body, and a cathode unit disposed at a first end surface of the electric insulating material body, wherein the heating wire leads out from a second end surface of the electric insulating material body.

With the above cathode structure, it is possible to suppress an amount of metal material such as barium reaching a part of the heating wire just exposed from the electric insulating material body and around a position of a surface of the electric insulating material body from which the heating wire leads out. This is because, in comparison with a conventional cathode structure in which a heating wire leads out from a side surface of a electric insulating material body, (i) a distance between the electron-emitting surface and a position from which the heating wire leads out of the electric insulating material body becomes longer, and (ii) the metal material such as barium evaporated from the electron-emitting surface has to turn around a flying direction in order to reach the position from which the heating wire leads out of the electric insulating material body.

As a result, it is possible to suppress short-circuits between the heating wire and the cathode unit and emission of unnecessary thermal electrons as much as possible, in comparison with the conventional cathode structure.

The first object of the present invention is also achieved by a cathode structure comprising a heater including a columnar electric insulating material body and a heating wire that is partially buried in the electric insulating material body and leads out from a side surface thereof, and a cathode unit disposed at one of end surfaces of the electric insulating material body, and emitting electrons from a surface of the cathode unit when heated by the heater, wherein the electric insulating material body includes a protrusion disposed on the side surface between a position from which the heating wire leads out and the surface of the cathode unit from which electrons are emitted.

With the above cathode structure, it is possible to suppress an amount of metal material such as barium reaching a part of the heating wire just exposed from the electric insulating material body and around a position of a surface of the electric insulating material body from which the heating wire leads out, because the cathode unit is disposed at one of the end surfaces of the columnar electric insulating material body, and the heating wire leads out from a side surface of the electric insulating material body, and the electric insulating material body includes a protrusion disposed on the side surface between a position from which the heating wire leads out and the surface of the cathode unit from which electrons are emitted. The protrusion prevents the metal material such as barium evaporated from the electron-emitting surface from reaching a position from which the heating wire leads out.

As a result, it is possible to suppress short-circuits between the heating wire and the cathode unit and emission of unnecessary thermal electrons as much as possible, in comparison with the conventional cathode structure.

A second object of the present invention is achieved by an electron gun including one of the above cathode structures.

A second object of the present invention is also achieved by an electron gun including another of the above cathode structures.

A third object of the present invention is achieved by a cathode structure a cathode ray tube including one of the above electron guns.

A third object of the present invention is also achieved by a cathode ray tube including another of the above electron guns.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes preferred embodiments of the present invention with reference to the drawings.

First Embodiment

Figure 2A:
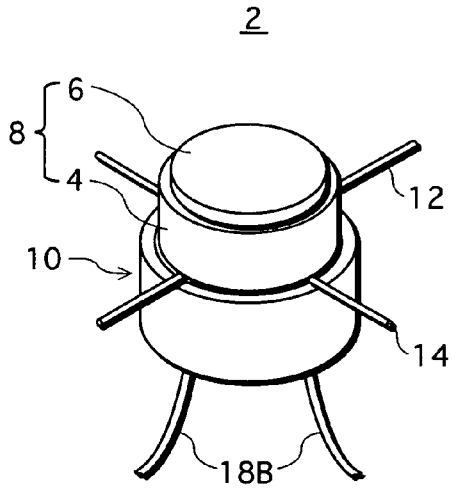
FIG. 2A is a perspective view of a cathode structure of a first embodiment according to the present invention, viewing from an angle from the top.
Figure 2C:
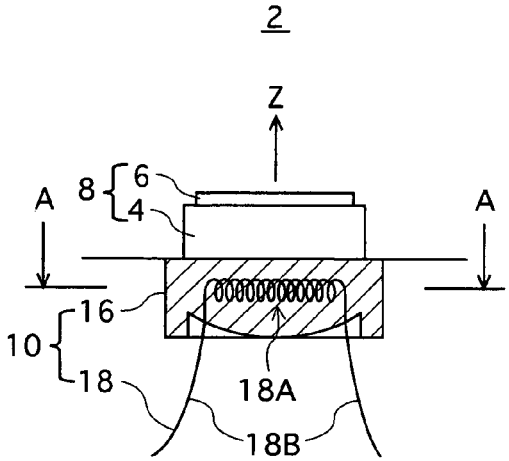
FIG. 2C is a partial cross-sectional view of the cathode structure of the first embodiment according to the present invention.
Figure 2B:
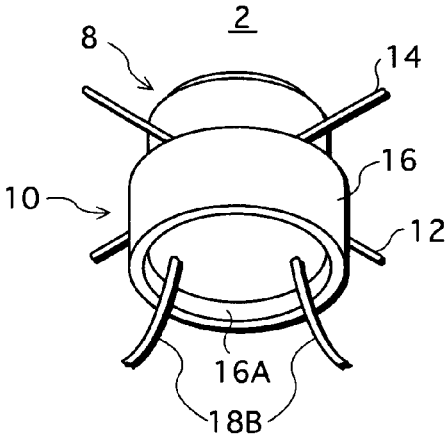
FIG. 2B is a perspective view of the cathode structure of the first embodiment according to the present invention, viewing from an angle from the bottom.
Figure 2D:
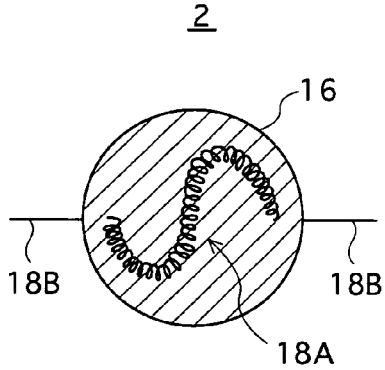
FIG. 2D is a cross sectional view taken at line A-A in FIG. 2C.

FIGS. 2A, 2B, 2C, and 2D illustrate a cathode structure 2 according to a first embodiment. FIG. 2A is a perspective view of the cathode structure 2 viewing from an angle from the top, and FIG. 2B is a perspective view of the same from an angle from the bottom. FIG. 2C is a partial cross-sectional view of a heater 10 which is to be described later, and FIG. 2D is a cross-sectional view taken at line A-A in FIG. 2C. For convenience, the cross-sectional views in FIGS. 2C and 2D only show cross-sections of a ceramic (electric insulating material) body 16 and not for a coiled part 18A.

The cathode structure 2 includes a cathode unit 8 having a cylindrical metal cup 4 and a circular columnar pellet 6 that is set in the metal cup 4, and a heater 10 that is almost circular columnar. The cathode structure 2 is structured in such a manner that the metal cup 4 and the heater 10 are connected each other, with supporting metal wires 12 and 14 crossing each other interposed between the metal cup 4 and the heater 10. A metal paste such as a molybdenum manganese (Mo—Mn) paste is used as a connecting material.

The pellet 6 is such that a porous refractory based material, made from tungsten (W) and having roughly a column-shape, is impregnated with an electron-emitting material including barium oxide (BaO), calcium oxide (CaO), and alumina ($Al_2O_3$), and a thin film made of osmium-ruthenium (Os—Ru) is deposited on one end surface. The end surface covered with the osmium-ruthenium film is an electron-emitting surface and exposed from the metal cup 4. As will be explained later, an electron gun accommodates the cathode structure 2 so that the electron-emitting surface of the cathode structure 2 becomes perpendicular to the tube axis of a cathode ray tube.

The metal cup 4 is made from molybdenum (Mo), and in a shape of a cylinder with bottom. The metal cup 4 is mainly provided in order to prevent unnecessary electrons from being emitted from a side of the pellet 6. The electron-emitting surface of the pellet 6 is slightly extending from the metal cup 4 so as to prevent the metal cup 4 from contacting with control electrode described later.

An example of wires used as the supporting metal wires 12 and 14 is tungsten-rhenium (W—Re) wires containing 74% of tungsten and 26% of rhenium. Note that the proportion of material used for the wires is not limited to the above described proportion. The supporting metal wires 12 and 14 are used as lead wires when applying a cathode voltage and an image signal voltage to the cathode unit 8, in addition to supporting the cathode structure 2 in the electron gun.

The heater 10 is made of the circular columnar ceramic body 16 and a heating wire 18 that is partially buried in the ceramic body.

The ceramic body 16 is a sintered body of alumina powder that is around 1 μm in diameter, and is greater than or equal to 95 wt % in purity. The diameter of a particle of the alumina powder is not limited to 1 μm, and may be in a range of 0.1 μm to 50 μm.

An example of wires used for the heating wire 18 is tungsten-rhenium (W—Re) wires containing 97% of tungsten and 3% of rhenium. The part of the heating wire 18 buried in the ceramic body 16 is coiled so as to form a coiled part 18A. The coiled part 18A is in an S shape as illustrated in FIG. 2D, along a section perpendicular to the tube axis (z axis) as shown in FIG. 2C. In comparison with a case in which the coiled part is coiled in a parallel section to the tube axis, the cathode structure 2 in the tube axis becomes shorter. Parts of the heating wire 18 that extend from the coiled part 18A lead out from an end surface of the ceramic body 16 opposite to the end surface at which the cathode unit 8 is disposed. Parts of the heating wire 18 that are exposed from the ceramic body 16 are hereinafter referred to as leading parts 18B.

An end surface of the ceramic body 16 where the heating wire 18 leads out has a dome shape. A wall 16A is disposed along a perimeter of the end surface of the ceramic body 16 so as to surround a position from which the heating wire 18 leads out of the end surface of the ceramic body 16. The heating wire 18 lead out from a position between the wall and a center of the second end surface.

The cathode structure 2 having the above described structure has the cathode unit at one end surface of the circular columnar ceramic body 16, and the parts of the heating wire 18 lead out from the other end surface of the ceramic body 16.

As a result, in comparison with a conventional cathode structure in which a heating wire leads out at a side of a ceramic body, it is possible to suppress an amount of barium attaching to the heating wire and a surface of the ceramic body where the heating wire leads out. The reasons for this are considered to be as follows.

As has been described in the above, barium evaporates and spreads from an exposed surface of the pellet of the metal cup (hereinafter referred to as an electron-emitting surface) when heated by the heater, and accumulates on the cathode structure as a whole. With the cathode structure 2 of the first embodiment, the cathode unit (electron-emitting surface) is disposed on one end surface of the ceramic body 16 and the heating wire 18 leads out from another end surface of the ceramic body 16. Accordingly, (i) a distance between the electron-emitting surface and the position from which the heating wire leads out of the ceramic body becomes long in comparison with the conventional cathode structure, and (ii) in order that barium atoms evaporated from the electron-emitting surface reach the position from which the heating wire leads out of the ceramic body, the barium atoms have to turn around to the other end surface of the ceramic body, i.e., turning the flying direction almost 180°. Because of the above reasons, it is considered that the amount of barium (Ba) attaching to the heating wire and a surface of the ceramic body where the heating wire leads out may be suppressed.

As a result, it is possible to prevent the heating wire and the cathode unit from short-circuiting as much as possible.

In the example explained in the above, barium (Ba) evaporates because the cathode unit impregnated with BaO is used. In a case in which other kind of metal is used for a cathode unit, a different kind of metal evaporates. In such a case, if the cathode structure of the first embodiment is employed, it is also possible to reduce the amount that the evaporated metal accumulates on the surface of the ceramic body.

Further, the wall 16A in the cathode structure 2 serves as a barrier when the barium atoms fly to an area around the position from which the heating wire 18 leads out, it is possible, by using the wall 16A, to reduce the amount of barium (Ba) attaching to the heating wire and a surface of the ceramic body where the heating wire leads out.

In addition, the end surface where the heating wire leads out has a dome shape, it is possible to obtain enough room for storing the coiled part in the ceramic body.

An example of sizes of parts of the cathode structure 2 is shown below.

The pellet 6 is 1.18 mm in diameter, 0.42 mm in thickness.

The metal cup 4 is 1.25 mm in outside diameter, 1.19 mm in inside diameter, 0.40 mm in height, and 0.37 mm in depth.

A circular cross section of the supporting metal wires 12 and 14 is 50 μm in diameter.

The ceramic body 16 is 1.5 mm in outside diameter and 0.5 mm in thickness. The wall 16A is 1.3 mm in inside diameter, and 0.1 mm in height.

A circular cross section of the heating wire 18 is 0.023 mm in diameter. The coiled part 18A is 0.146 mm in outside diameter with a coil pitch of 0.036 mm.

The cathode structure 2 having the above structure is a component of an in-line electron gun, and the in-line electron gun is a component of a color cathode ray tube.

Figure 3:
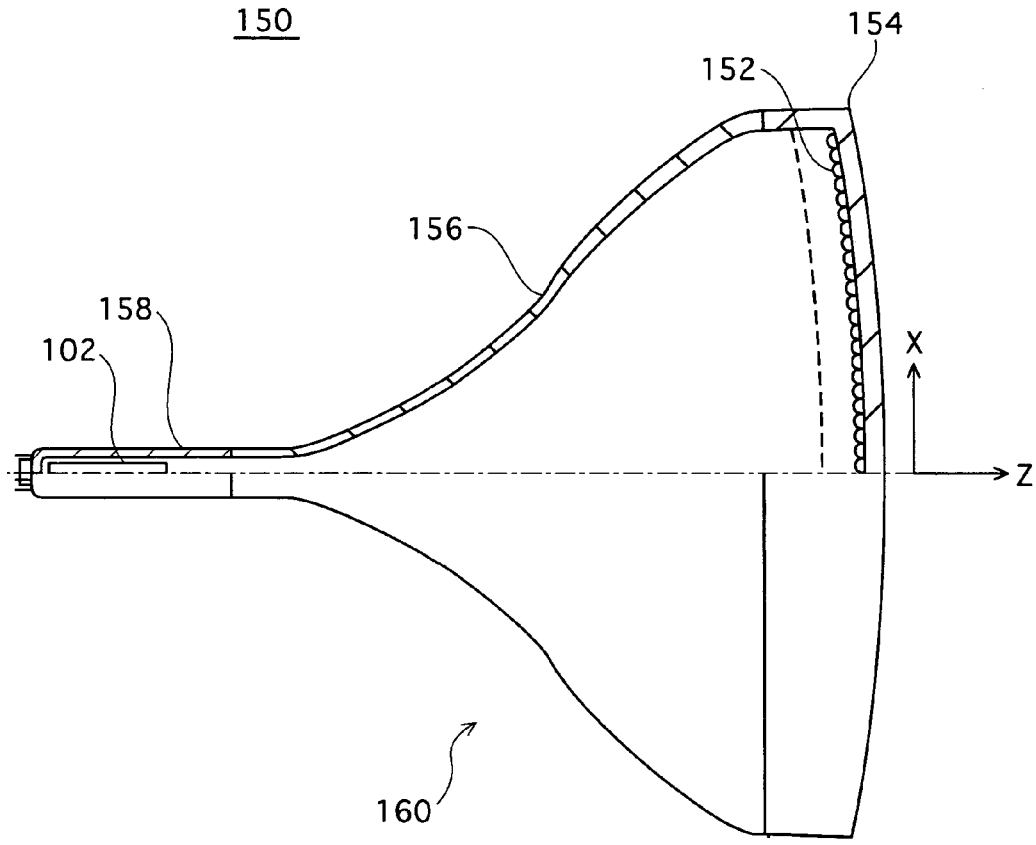
FIG. 3 is a partial cross-sectional view illustrating an overall structure of a color cathode ray tube of embodiments.

FIG. 3 shows a partial cross-sectional view illustrating an overall structure of a color cathode ray tube 150 according to the embodiments.

As shown in FIG. 3, the color cathode ray tube 150 includes a glass bulb 160 in which a front panel 154 having a phosphor screen 152 thereon, a funnel 156, and a thin cylindrical neck 158 are put together in a stated order, and an in-line electron gun 102 contained in the neck 158.

Figure 4:
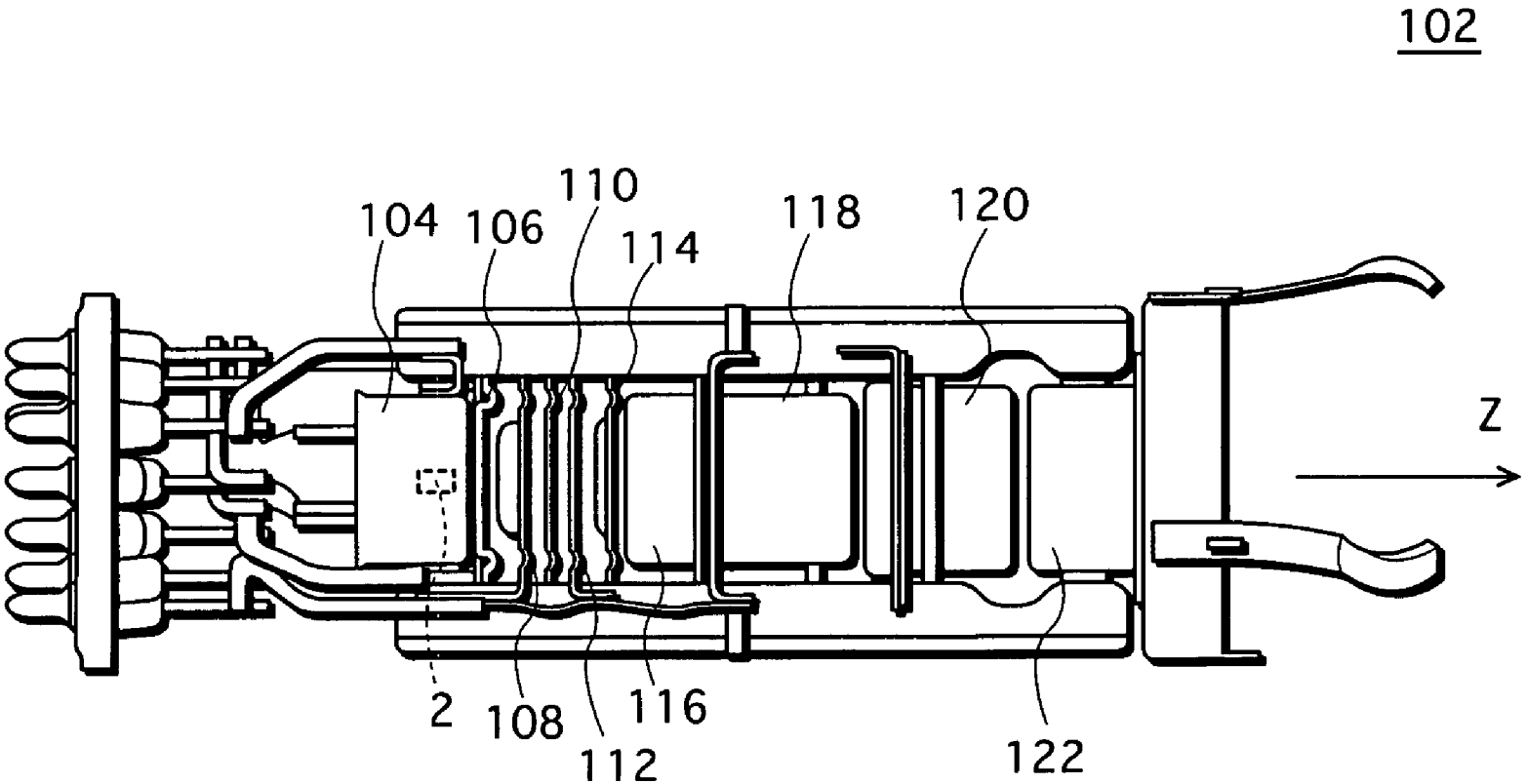
FIG. 4 is a diagram illustrating an electron gun in which the cathode structure of the embodiments is included.

FIG. 4 is a diagram illustrating an overall structure of the in-line electron gun (hereinafter referred to as electron gun) 102.

As shown in FIG. 4, the electron gun 102 is disposed so as to lie along the tube axial direction (z axis), and includes a control electrode 104 that has a cylindrical shape with a bottom, an acceleration electrode 106, convergence electrodes 108-120, and a final acceleration electrode 122 in a stated order from left to right in the drawing (to the phosphor screen 152 in FIG. 3). In the control electrode 104, three cathode structures 2 each corresponding to R (red), G (green), or B (blue), respectively, are placed along a horizontal axis (x axis) perpendicular with the tube axis. The control electrode 104 has openings at a bottom thereof, each corresponding to each of the cathode structures 2. The cathode structures, each corresponding to R (red), G (green), or B (blue), respectively, have the same structure. In a case in which distinction between the cathode structures with different colors, color codes R, G, and B are added to the reference number. For example, a cathode structure for R (red) is shown as a cathode structure 2R.

Electrons released from the cathode structures 2 are converged at a cathode lens formed by the control electrode 104 and the acceleration electrode 106 so as to form a crossover, then further proceed and are focused at a pre-focus lens and a main focus lens formed by the acceleration electrode 106, the convergence electrodes 108-120, and the final acceleration electrode 122, so as to converge on the phosphor screen.

Figure 5:
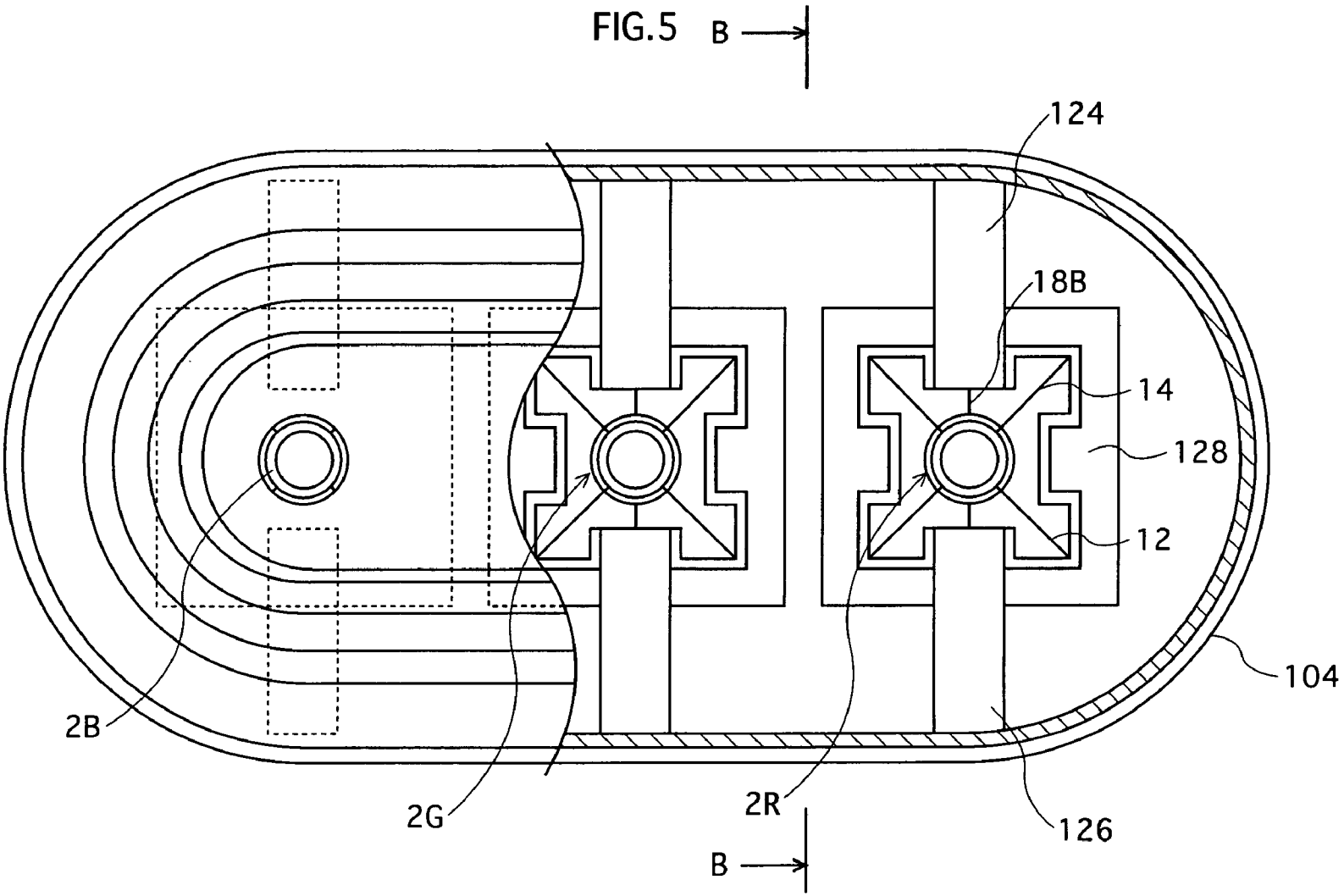
FIG. 5 shows a part at which the cathode structure is attached to the electron gun.
Figure 6:
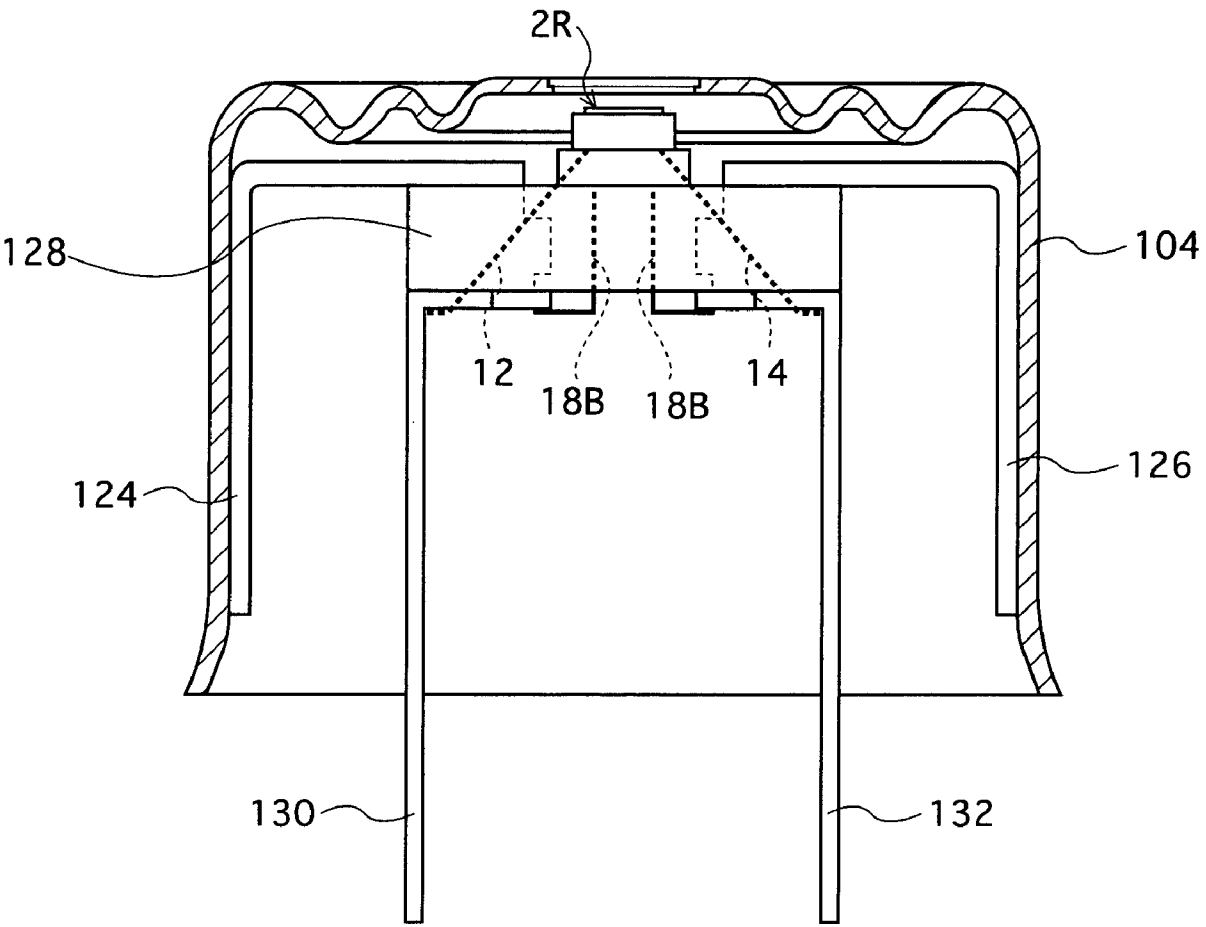
FIG. 6 is a cross-sectional view taken at line B-B in FIG. 5.
Figure 7:
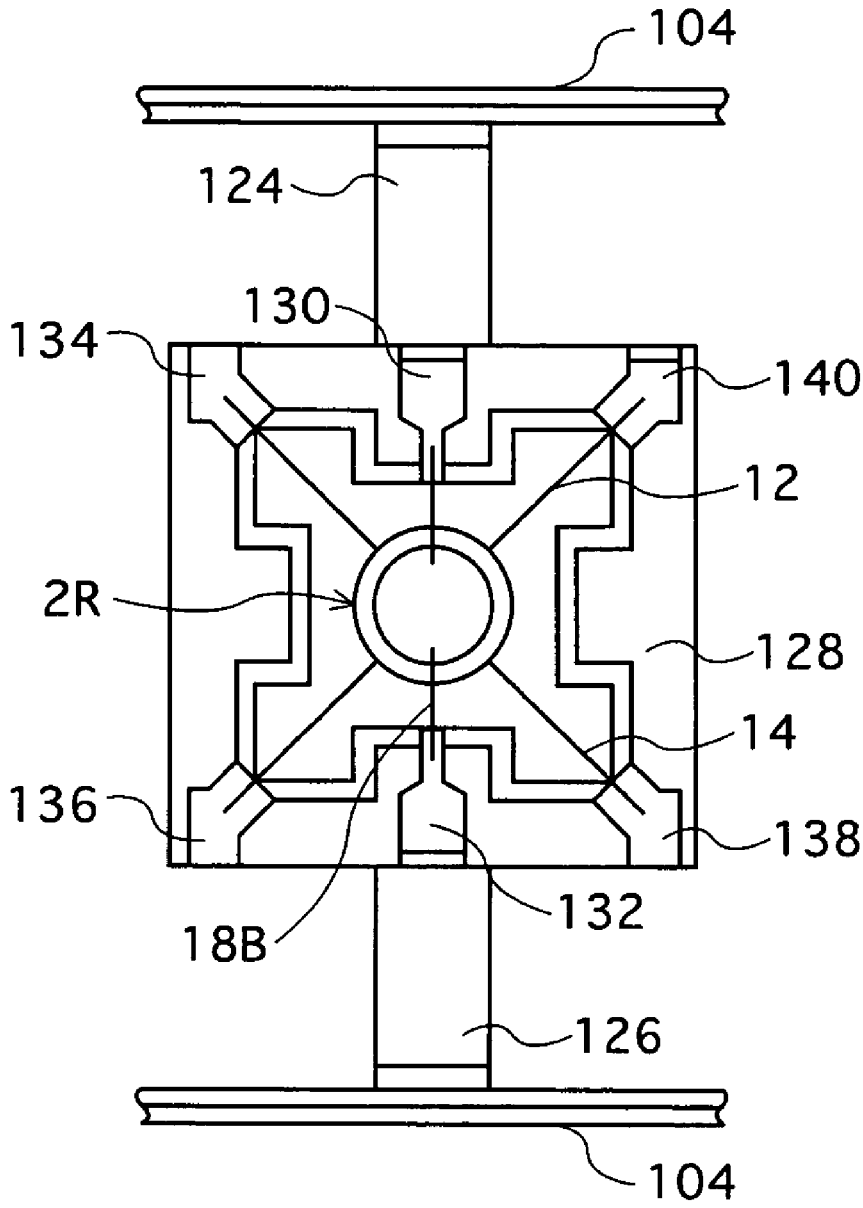
FIG. 7 is a rear view of a part of FIG. 5.

FIG. 5 is a diagram that shows the control electrode 104 and the cathode structure 2 viewed from a side of the phosphor screen 152 in FIG. 3. The control electrode 104 in FIG. 5 is shown partially broken. FIG. 6 is a cross-sectional view taken at line B-B in FIG. 5, and FIG. 7 shows a part of FIG. 5 from an opposite side of the phosphor screen 152 in FIG. 3.

As shown in FIG. 5, the cathode structures 2B, 2G, and 2R are lined up from left to right in the stated order on a horizontal axis viewing from the phosphor screen 152, and contained in the control electrode 104.

The cathode structures 2B, 2G, and 2R are attached to the control electrode 104 in the same manner. Therefore, the explanation here is given taking up a case of the cathode structures 2R as an example.

As shown in FIG. 5 and FIG. 6, L-shaped metal angling members (hereinafter referred to as angling members) 124 and 126 are fixed facing each other to an internal wall of the control electrode 104.

An insulating substrate 128 made of ceramic and shaped in an almost rectangular frame is attached to both edges of the angling members 124 and 126.

L-shaped power supplying members 130 and 132 are attached to the insulating substrate 128 at an opposite side of a surface to which the insulating substrate 128 and the angling members 124 and 126 are attached.

As shown in FIG. 7, metal plates 134, 136, 138, and 140 are attached to four corners of the insulating substrate 128.

A main body of the cathode structure 2R (the heater 10 excluding the cathode unit 8 and the leading parts 18B) is positioned closer to the phosphor screen than to the insulating substrate 128. The metal supporting wires 12 and 14 supporting the cathode structure 2R are put through an opening of the insulating substrate 128 and each of four edges of the metal supporting wires 12 and 14 are attached to the corresponding metal plates 134, 136, 138, and 140, respectively. Specifically, the cathode structure 2R is supported by the insulating substrate (metal plates 134-140) via the metal supporting wires 12 and 14 as leg parts. A lead wire not shown in the drawing is connected to the metal plate 140, and the cathode voltage and the image signal voltage are applied to the metal plate via the lead wires. The voltage applied to the metal plate is in a range of 30 v to 200 v.

The edges of the leading parts 18B of the heating wire 18 of the cathode structure 2R are connected to the corresponding edges of the power supplying members 130 and 132. From a power source not shown in the drawing, a voltage of 6.3 v is applied to the heating wire 18 via the supplying members 130 by which the heating wire 18 generates heat.

Next, a manufacturing method of the cathode structure 2 is described below.

Figure 8:
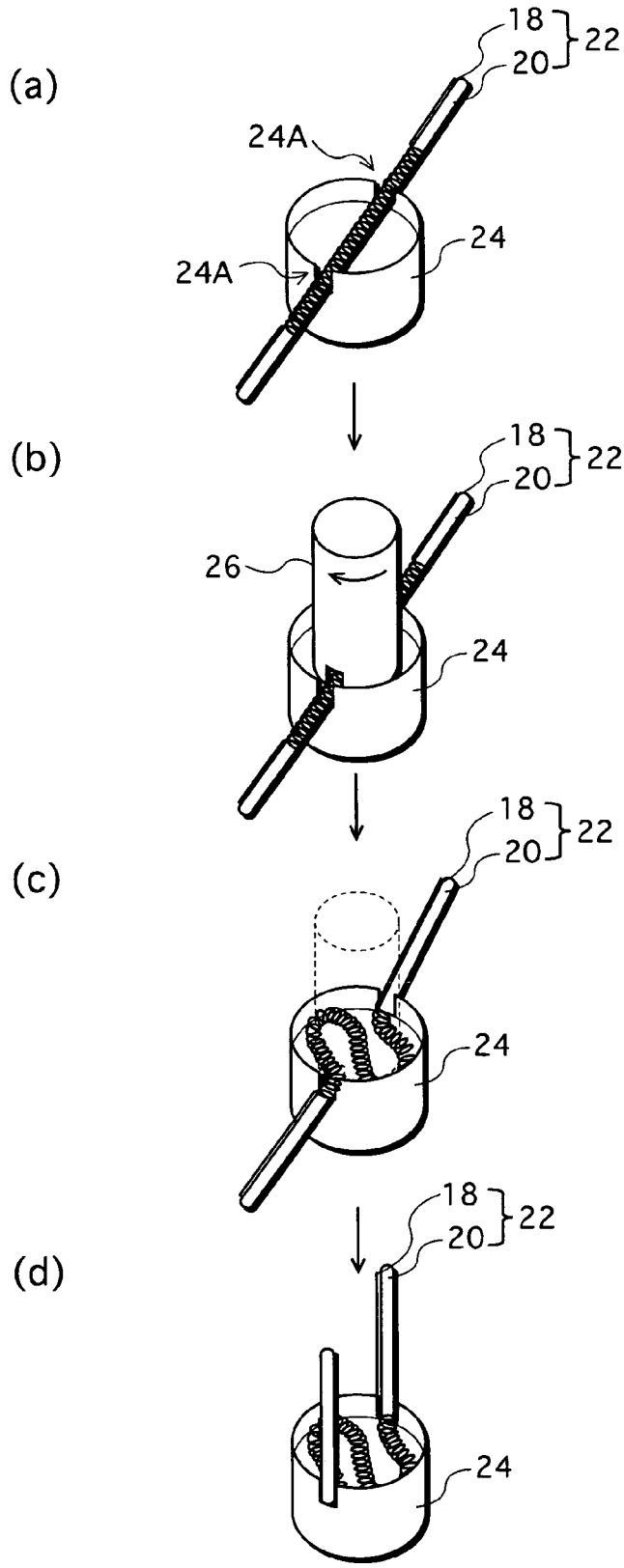
FIG. 8 illustrates a part of manufacturing steps of the cathode structure of the embodiments.

FIG. 8 illustrates a manufacturing step in which the coiled part 18A of the heating wire 18 (FIG. 2) is formed in an S shape.

Figure 9A:
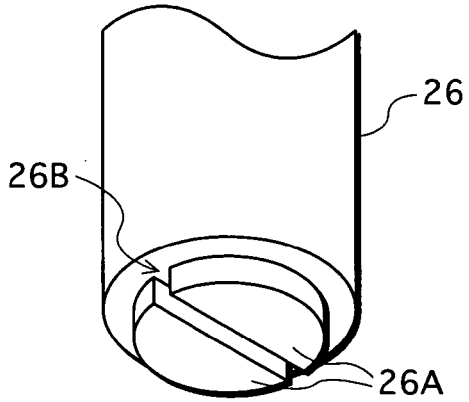
FIG. 9A is a perspective view illustrating a bottom part of a mandrel used in the manufacturing process.
Figure 9B:
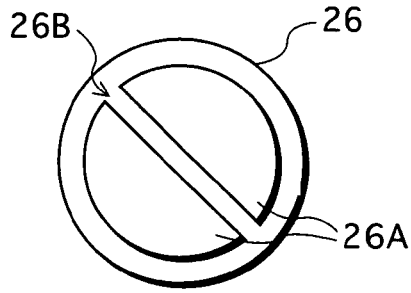
FIG. 9B is a bottom view of the mandrel.

A forming frame 24 and a mandrel 26 are used in this step. The forming frame 24 has a cylindrical shape with a bottom, and has two cutouts 24A at opposing edges of a wall. The mandrel 26 is, as shown in FIG. 9A, in a circular columnar shape with two semicircular raised parts 26A that face each other on a bottom surface. The raised parts 26A form a groove 26B at a part between the two raised parts 26A face each other.

Before this manufacturing step starts, a rodded member 22 is prepared. The rodded member 22 comprises a rod 20 made of molybdenum and the heating wire 18 that is wound around the rod 20.

The rodded member 22 is set in the forming frame 24 so as to fit in the cutouts 24A, as shown in (a) of FIG. 8.

Next, as shown in (b) of FIG. 8, the mandrel 26 is set in the forming frame 24 so that the groove 26B fits with the rodded member 22, and rotated a little less than 180 degrees to a direction indicated by an arrow in the drawing.

By doing so, the rodded member 22 is twisted in an S shape, as shown in (c) of FIG. 8.

Then, as shown in (d) of FIG. 8, the mandrel 26 is removed, and ends of the rodded member 22 are bent upward. Finally, the rodded member 22 is removed from the forming frame 24.

Figure 9C:
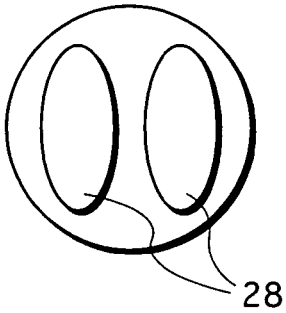
FIG. 9C is a bottom view of the mandrel in a variation.
Figure 9D:
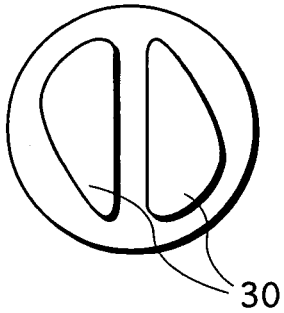
FIG. 9D is a bottom view of the mandrel in a variation.
Figure 9E:
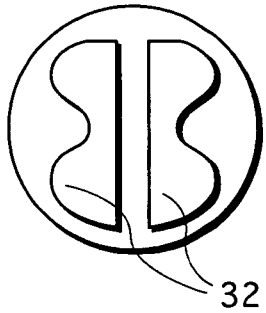
FIG. 9E is a bottom view of the mandrel in a variation.

In an example described above, the mandrel 26 has the semicircular raised parts 26A facing each other. However, the raised parts may be other than the semicircle, depending on a desired shape for the coiled part 18A. For example, the raised parts may be any of oval raised parts 28 as shown in FIG. 9C, tear-shaped raised parts 30 as shown in FIG. 9D, and raised parts 32 having waved parts as shown in FIG. 9E.

Figure 10B:
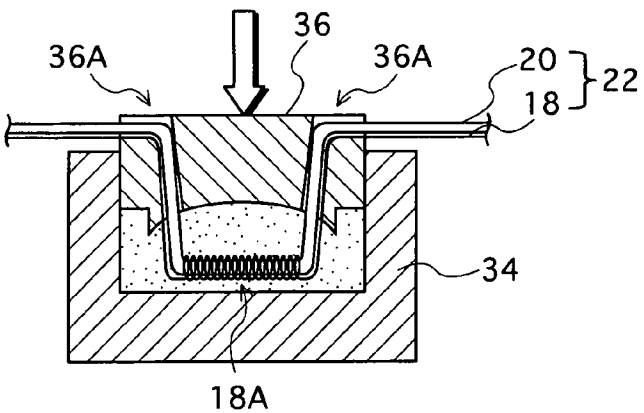
FIG. 10B illustrates a part of manufacturing steps of the cathode structure of the embodiments.
Figure 10A:
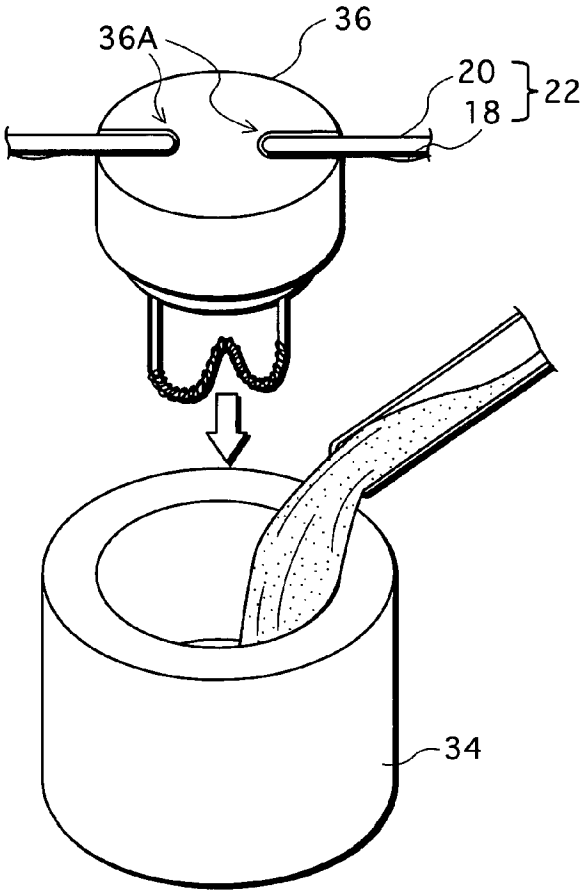
FIG. 10A illustrates a part of manufacturing steps of the cathode structure of the embodiments.

FIGS. 10A and 10B illustrate a part of forming steps of the ceramic body 16.

In the forming step, metal molds are used. As shown in FIGS. 10A and 10B, the metal molds includes a lower mold 34 and an upper mold 36. Alumina powder is put into the lower mold. 34 and pressed by the upper mold 34 so as to be caked into a shape of the ceramic body 16.

The lower mold 34 is a cylinder with a bottom. A lower surface of the upper mold 36 is a reverse copy of the surface of the ceramic body 16 where the heating wire 18 leads out. Further, the upper mold 36 has two penetrating holes 36A from the lower surface to an upper surface.

As shown in FIG. 10A, alumina powder that is measured to be an adequate amount is put into the lower mold 34. Also, the rodded member 22 that has already bent in an S shape is set in the upper mold 36 in a manner that the both ends of the rodded member 22 go through the penetrating holes 36A from bottom to up, and parts of the both ends of the rodded member 22 extending from the upper surface of the upper molds 36 are bent.

The upper mold 26 that is set with the rodded member 22 as has been described above is inserted into the lower mold 34 as shown in FIG. 10B, and pressed at a predetermined pressure in a direction that an arrow indicates so as to cake the alumina powder. At this time, the coiled part 18A is still wound around the rod 20, and accordingly the shape of the coiled part does not become distorted and flattened and is in direct contact with the alumina powder.

When the above caking step is completed, the caked alumina powder is taken out of the metal molds and sintered in a furnace (not shown in the drawing) at a temperature around 1600° C.

After that, the sintered alumina powder is immersed in a mixed acid of nitric acid and sulfuric acid, and the rod 20 is dissolved and removed. Thus the heater 10 is finished up.

Figure 11A:
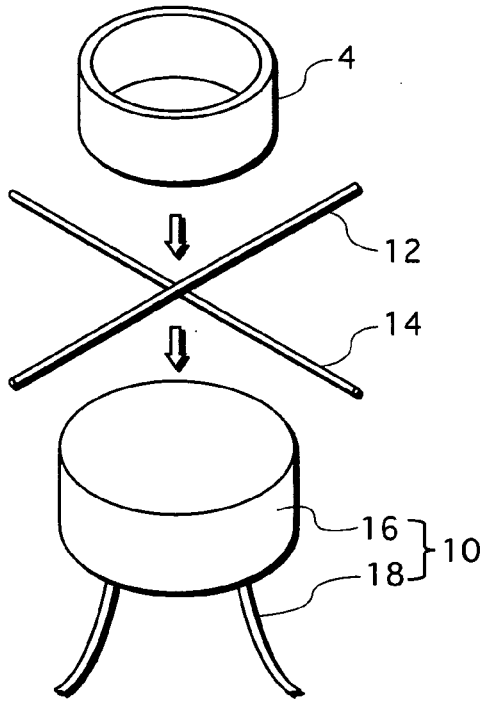
FIG. 11A illustrates a part of manufacturing steps of the cathode structure of the embodiments.

Next, the heater 10 and the metal cup 4 are joined. As shown in FIG. 11A, the supporting metal wires 12 and 14 are disposed so as to cross perpendicular at a center of one of the end surfaces of the ceramic body 16. An adequate amount of a molybdenum manganese (Mo—Mn) paste (not shown in the drawing) is applied over the supporting metal wires 12 and 14, and the metal cup 4 is attached after that. Then, the heater 10 and the metal cup 4 are heated in the furnace at a temperature around 1600° C. so as to solidify the paste in order that the ceramic body 16 and the metal cup 4 are joined.

Figure 11B:
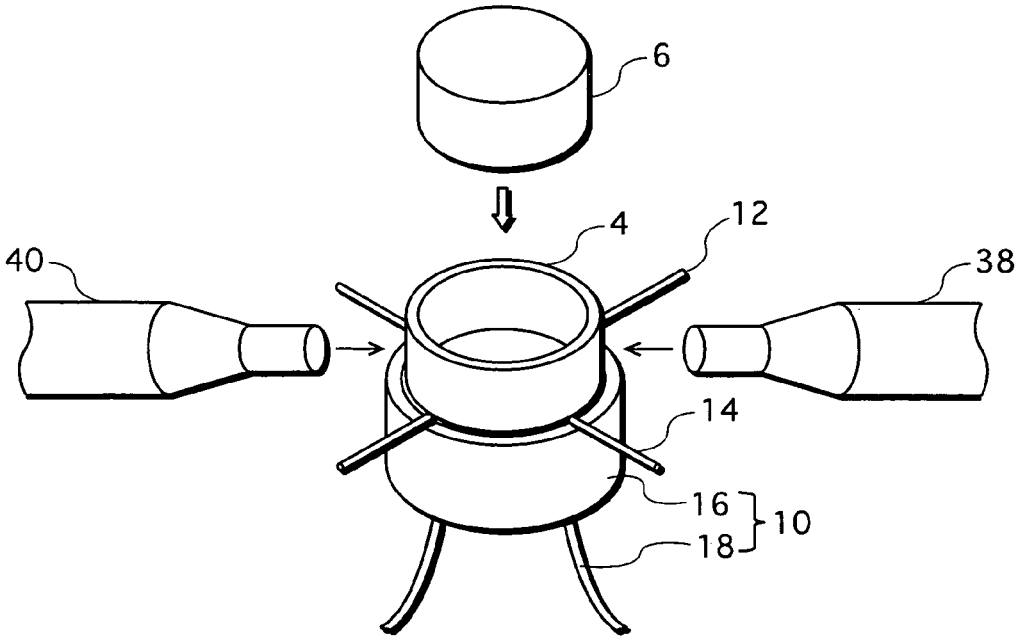
FIG. 11B illustrates a part of manufacturing steps of the cathode structure of the embodiments.

After the adhesion is done, the metal cup 4 and the pellet 6 are put together using resistance welding. First, as shown in FIG. 11B, the pellet 6 is set in the metal cup 4. With the pellet 6 set in the metal cup 4, electrodes 38 and 40 are connected to opposite sides of the metal cup 4, and a welding current is applied between the both electrodes so as to weld the metal cup 4 and the pellet 6.

After completion of the above steps, the cathode structure 2 is finished up.

Note that the heater may take a different shape other than the shape illustrated in FIGS. 2A-2D, insofar as the shape of the heater does not extend beyond the basic idea of the present invention. Variations of the shape of the heater are described below, in reference to FIGS. 12A, 12B, 12C, 12D, and 12E.

Each of FIGS. 12A to 12E shows a variation of the cathode structure, and the heater in the drawings is shown cross-sectioned, like in FIG. 2C. For convenience, the supporting metal wires are not shown in FIGS. 12A to 12E. The same reference numbers are attached to the same components of the embodiment, and explanations for such components are not given.

[Variation 1]

Figure 12A:
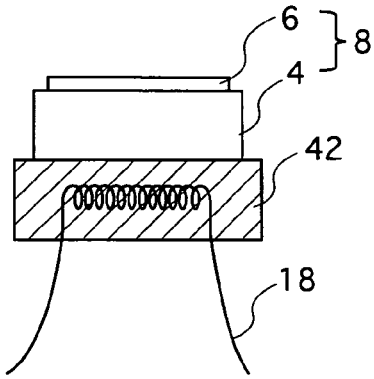
FIG. 12A illustrates the cathode structure as a variation of the first embodiment.

As shown in FIG. 12A, a ceramic body 42 may be formed in a simple circular columnar shape. Because the heating wire 18 leads out from an end surface of the ceramic body opposite to an end surface at which the cathode unit is disposed, the same effect as the above explained embodiment is achieved even in such a case.

[Variation 2]

Figure 12D:
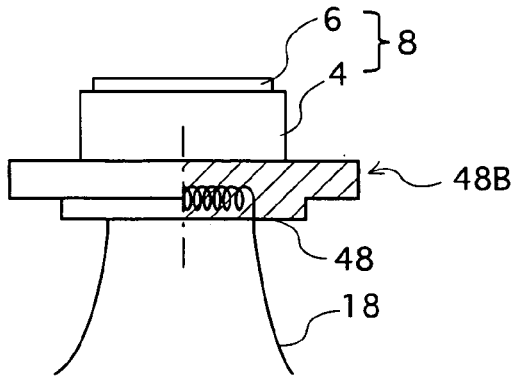
FIG. 12D illustrates the cathode structure as a variation of the first embodiment.
Figure 12B:
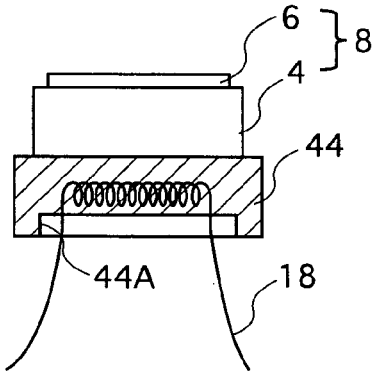
FIG. 12B illustrates the cathode structure as a variation of the first embodiment.

As shown in FIG. 12B, a ceramic body 44 may be formed in a circular columnar shape with a wall 44A disposed on an end surface from which the heating wire 18 leads out, so as to surround a position from which the heating wire 18 leads out. By doing so, it is possible to obtain the same effect as the wall 16A (FIG. 2B) of the first embodiment, in addition to the effect of the variation 1.

[Variation 3]

Figure 12E:
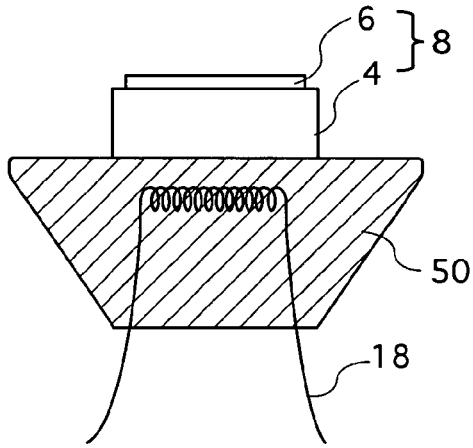
FIG. 12E illustrates the cathode structure as a variation of the first embodiment.
Figure 12C:
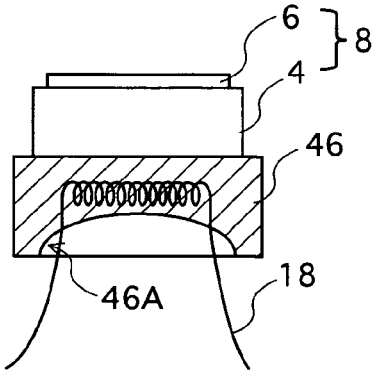
FIG. 12C illustrates the cathode structure as a variation of the first embodiment.

As shown in FIG. 12C, a ceramic body 46 may be formed in a circular columnar shape with a concave end surface from which the heating wire 18 leads out. By making the end surface concave, a wall-like part 46A is formed at a perimeter of the end surface, and it is possible to obtain the same effect as the variation 2.

[Variation 4]

As shown in FIG. 12D, a ceramic body 48 may be formed in a circular columnar shape with a part 48B having a larger diameter than that of an end surface from which the heating wire 18 leads out. By having the part 48B, it is further possible to suppress accumulation of barium on the heating wire and a surface of the ceramic body in vicinity where the heating wire leads out.

[Variation 5]

As shown in FIG. 12E, a ceramic body 50 may be formed in an inverted circular truncated cone shape. With such a shape, a diameter gradually increases from an end surface where the heating wire 18 leads out to another end surface at which the cathode unit 8 is disposed. Accordingly, it is possible to obtain the same effect as the variation 4.

Second Embodiment

A second embodiment is different from the first embodiment in a structure of the heater of the cathode structure. Other components, such as the electron gun, are the same as the first embodiment. Therefore, explanation is given mainly to a different part from the first embodiment.

Figure 13A:
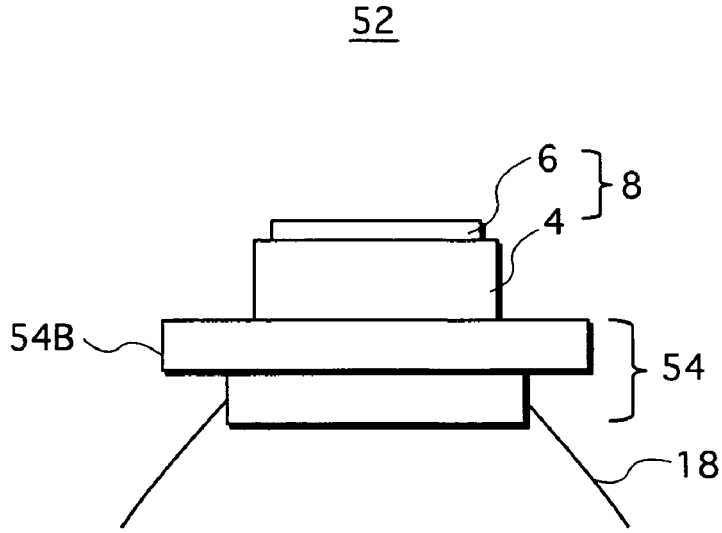
FIG. 13A is a side view of a cathode structure as a second embodiment.
Figure 13B:
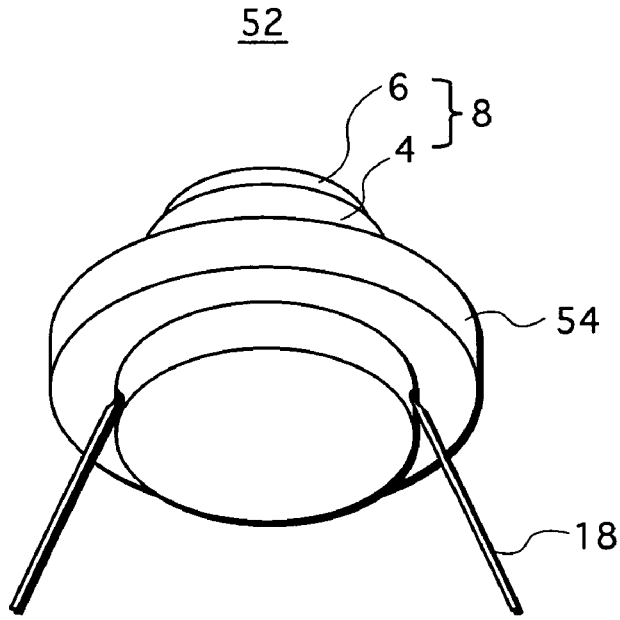
FIG. 13B is a perspective view of the cathode structure of the second embodiment, viewing from an angle from the bottom.

FIGS. 13A and 13B illustrate a cathode structure 52 of the second embodiment. FIG. 13A is a side view of the cathode structure 52, and FIG. 13B is a perspective view of the cathode structure 52, viewing from an angle from the bottom.

In the cathode structure 52 according to the second embodiment, the heating wire 18 leads out from a side surface of a circular columnar ceramic body 54. The cathode structure 52 includes a large diameter part 54B between the exposed surface of the pellet 6 (electron emitting surface) and a part from which the heating wire 18 leads out of the side surface. A diameter of the ceramic body at the large diameter part 54B is larger than that at the part from which the heating wire 18 leads out of the side surface. Accordingly, the large diameter part 54B becomes a protrusion that suppresses accumulation of barium on the heating wire 18 and the surface of the ceramic body in vicinity where the heating wire 18 leads out.

Although the protrusion (the large diameter part 54B) is disposed on the side surface around a circumference of the ceramic body 54 in the above example, it is not necessarily required to dispose the protrusion around the circumference. It is sufficient that the protrusion is disposed at least on a shortest route between a position from which the heating wire 18 leads out of the side surface and the exposed surface of the pellet 6 (electron-emitting surface). By having such a protrusion, it is possible to suppress accumulation of barium on the heating wire and a surface of the ceramic body in vicinity where the heating wire leads out.

Figure 14A:
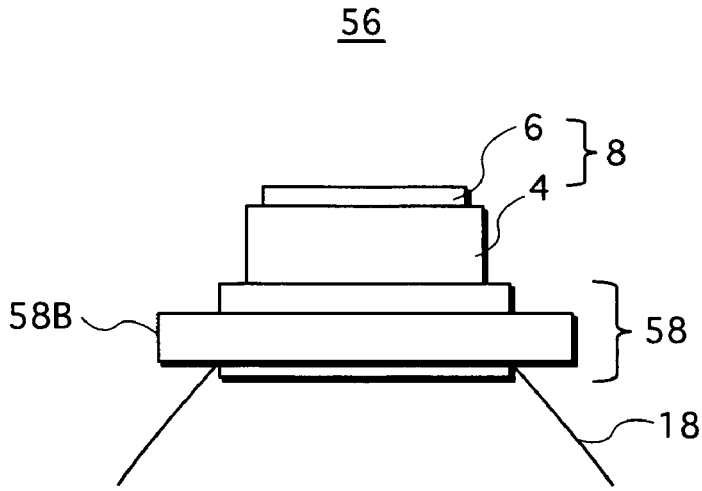
FIG. 14A illustrates the cathode structure as a variation of the second embodiment.

Descriptions about variations of the second embodiment 2 are given below, in reference to FIGS. 14A and 14B.

[Variation 1]

In the cathode structure 52 illustrated in FIGS. 13A and 13B, an upper half of the ceramic body 54 is the large diameter part. However, in a cathode structure 56 shown in FIG. 14A, a large diameter part 58B is disposed at middle of the ceramic body. By having the large diameter part 58B at middle of the ceramic body, it is possible to suppress accumulation of barium on the heating wire and a surface of the ceramic body in vicinity where the heating wire leads out, like in the example shown in FIGS. 13A and 13B.

[Variation 2]

Figure 14B:
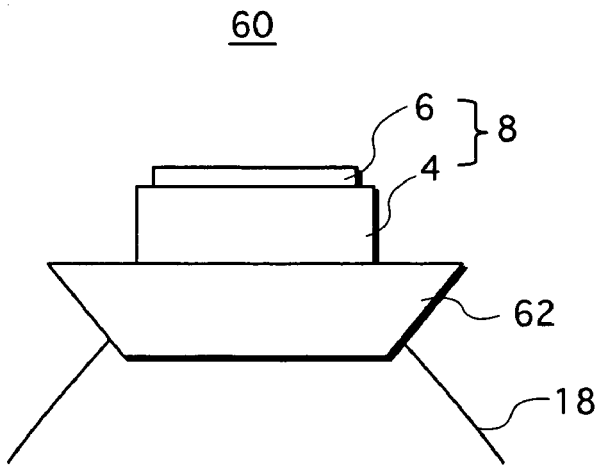
FIG. 14B illustrates the cathode structure as a variation of the second embodiment.

In a cathode structure 60 of a variation 2 shown in FIG. 14B, a ceramic body 62 is in an inverted circular truncated cone shape and the heating wire 18 leads out from a side surface of the ceramic body 62. By this, the protrusion is disposed on at least on a shortest line between a position from which the heating wire 18 leads out of the side surface and the exposed surface of the pellet 6 (electron-emitting surface), and it is possible to suppress accumulation of barium on the heating wire and a surface of the ceramic body in vicinity where the heating wire leads out.

The present invention has been described above according to the preferred embodiments. However, the present invention is not limited to the above embodiments, and may be achieved by such examples below.

(1) In the above embodiments, molybdenum (Mo) is used as material for the metal cup. However, the material for the metal cup is not limited to molybdenum. For example, the material for the metal cup may be one of tantalum (Ta), rhenium (Re), zirconium (Zr), and niobium (Nb). In other words, any refractory metal may be used as the material for the metal cup.

(2) In the above embodiments, the supporting metal wires have a circular cross section. However, the cross section of the supporting metal wires is not limited to a circular cross section, and may be quadrilateral. In addition, material for the supporting metal wires is not limited to tungsten-rhenium (W—Re), but may be any refractory metal such as tantalum (Ta), rhenium (Re), zirconium (Zr), and niobium (Nb). Further, a number of the supporting metal wires in the above embodiments are two, and both ends of two wires extend in four radial directions. However, a number of the ends of the wires that extend radially is not limited to four, and may be two or three. In this case, a design of the electron gun at a part for attaching the cathode structure will also be modified.

(3) In the above embodiments, the emitter is an impregnated type (pellet 6). However, the emitter may be an oxide type. In this case, a metal disk is used instead of the metal cup. Material for the metal disk is nickel (Ni) with a minute amount of reducing agent such as magnesium (Mg). The metal disk is 0.1 mm in thickness and in a rage of 1.6 mm to 1.9 mm in diameter. An oxide (BaO, SrO, and CaO) is applied to one surface of the disk, which is an opposite surface to a surface that faces the heater.

(4) In the above embodiments, the ceramic body is a circular column. However, the shape of the ceramic body is not limited to the circular column, and may be such as a quadrilateral column or a polygonal column.

Figure 1A:
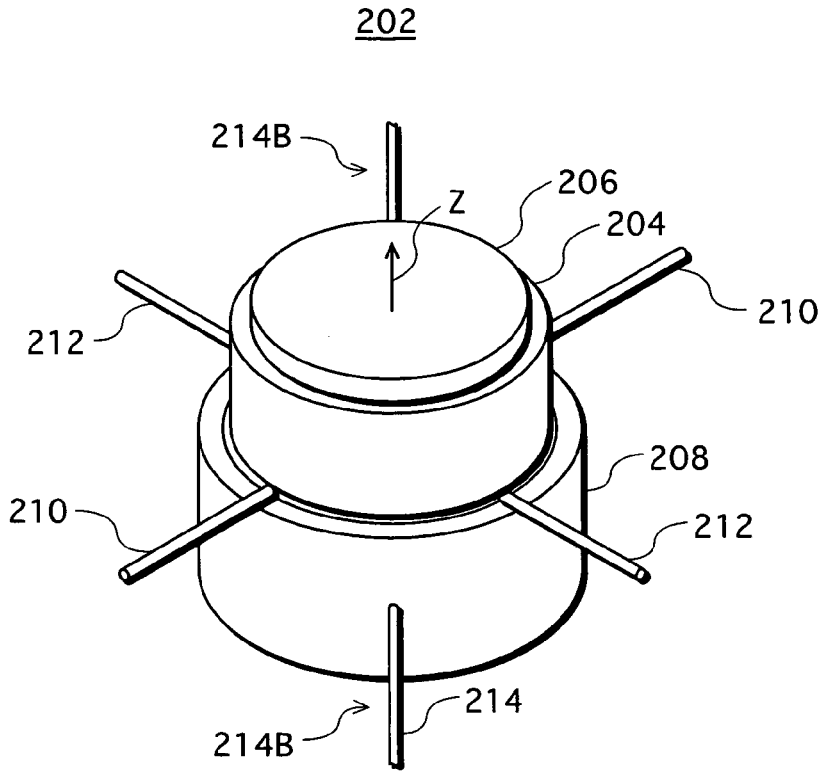
FIG.1A PRIOR ART
FIG. 1A is a diagram showing a conventional cathode structure.
Figure 1B:
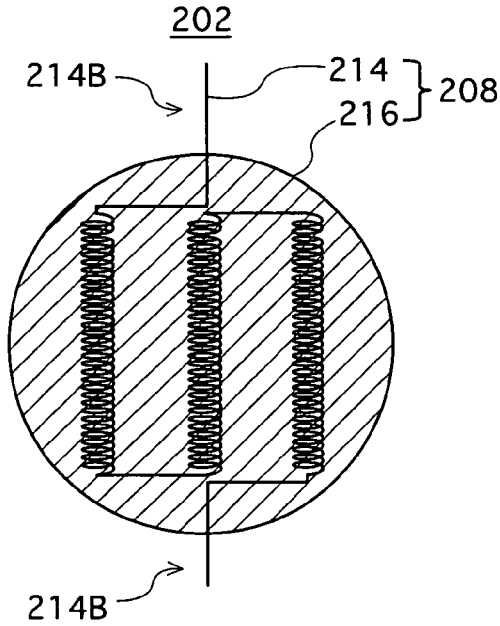
FIG.1B PRIOR ART
FIG. 1B is a diagram showing the conventional cathode structure.

(5) In the above embodiments, the coiled part is S-shaped. However, the shape of the coiled part is not limited to the S shape, and may be such a shape as shown in FIG. 1B.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cathode structure comprising:

a heater including a columnar electric insulating material body having a diameter larger than a height and a heating wire that is partially buried and in contact with the electric insulating material body, wherein the heating wire is coiled, within the insulating material body, around a first axis;

a cathode unit is disposed at a first end surface of the electric insulating material body including a metal cup and a pellet member supported in the metal cup, the pellet member containing an electron-emitting material; and a supporting metal wire attached to the cathode structure between the metal cup and the heater, wherein the heating wire leads out from a second end surface of the electric insulating material body and the first axis of the coiled heating wire is parallel to the first end surface of the electric insulating material to provide a compact configuration for the cathode structure with an enlarged heat transmitting capacity.

2. A cathode structure according to claim 1, wherein the electric insulating material body includes a wall disposed on the second end surface so as to surround a position from which the heating wire leads out.

3. A cathode structure according to claim 2, wherein the wall is disposed around a perimeter of the second end surface, the second end surface surrounded by the wall rises in a dome shape, and the heating wire leads out from a position between the wall and a center of the second end surface.

4. A cathode structure according to claim 1, wherein the electric insulating material body is in a circular columnar shape, and includes a part that has a greater diameter than that of the second end surface.

5. An electron gun including a cathode structure according to claim 1.

6. A cathode ray tube including an electron gun according to claim 5.

7. A cathode structure according to claim 1 wherein the electron-emitting material contains barium oxide.

8. A cathode structure according to claim 1 wherein the electric insulating material body is made of ceramic.

9. A cathode structure according to claim 1 wherein a plurality of supporting metal wires are attached to the cathode structure between the metal cup and the heater and extend outward from the side of the cathode structure.

10. A cathode structure according to claim 9 wherein the heater wire is coiled into an S shape when viewed perpendicular to an axis through the cathode structure.

11. A cathode structure according to claim 1 wherein the columnar electric insulating material body has a trapezoidal cross-sectional shape.

12. A cathode structure according to claim 1 wherein the columnar electric insulating material body has a cylinder shape with a lower extending annular wall surrounding the exit of the heating wire from the second end surface.

13. A cathode structure comprising:

a heater including a columnar electric insulating material body having a diameter larger than a height and a heating wire that is partially buried and in contact with the electric insulating material body and leads out from a side surface thereof, wherein the heating wire is coiled, within the insulating material body, around a first axis transverse to the side surface; and a cathode unit disposed at one of an end surface of the electric insulating material body, and emitting electrons from a surface of the cathode unit when heated by the heater, the cathode unit includes a metal cup and a pellet member containing an electron-emitting material supported in the metal cup, wherein the electric insulating material body includes a protrusion disposed on the side surface between a position from which the heating wire leads out and the surface of the cathode unit from which electrons are emitted.

14. An electron gun including a cathode structure according to claim 13.

15. A cathode ray tube including an electron gun according to claim 14.

16. A cathode structure according to claim 13 wherein the electron-emitting material contains barium oxide.

17. A cathode structure according to claim 13 wherein the electric insulating material body is made of ceramic.

18. A cathode structure according to claim 13 wherein further comprising a supporting metal wire attached to the cathode structure between the metal cup and the heater.

19. A cathode structure for an electron gun comprising:

a metal cylindrical open cup with a columnar pellet mounted in the metal cup, the columnar pellet contained within an inner diameter of the metal cup and extending above the metal cup to emit electrons;

a columnar electric insulating material body having a diameter larger than a height including a heating wire, in contact with insulating material of the insulating material body, having electrode leads extending from one end of the insulating material body, wherein the heating wire is coiled, within the insulating material body, around a first axis parallel to the electron emitting surface of the columnar pellet; and a plurality of support wires attached to the cathode structure between a bottom of the metal cup and a surface of another end of the columnar electric insulating material body, to extend laterally outward from the bottom of the metal cup, wherein heat from the heating wire is transmitted to the metal cup to enable the columnar pellet to emit electrons, the columnar electric insulating material body having a lower extending annular wall surrounding the electrode leads to suppress the electron emitting material from attaching to the electrode leads.

20. A cathode structure according to claim 19 wherein barium oxide is the electron emitting material in the columnar pellet, and a surface of the columnar pellet above the metal cup is covered with an osmium-ruthenium thin film.

21. A cathode structure comprising:

a heater including a columnar electric insulating material body having a diameter larger than a height and a heating wire that is partially buried and in contact with the electric insulating material body; and a cathode unit disposed at a first end surface of the electric insulating material body including a metal cup and a pellet member supported in the metal cup, the pellet member containing an electron-emitting material, wherein the heating wire leads out from a second end surface of the electric insulating material body, wherein the electric insulating body is in a circular columnar shape with a longitudinal axis, and includes a part that has a greater diameter than that of the second end surface and the heating wire is coiled, within the insulating material body, around a first axis positioned transverse to the longitudinal axis to enable a compact configuration for the cathode structure.

22. A cathode structure comprising:

a heater including a columnar electric insulating material body and a heating wire that is partially buried and in contact with the electric insulating material body; and a cathode unit disposed at a first end surface of the electric insulating material body including a metal cup and a pellet member supported in the metal cup, the pellet member containing an electron-emitting material, wherein the heating wire leads out from a second end surface of the electric insulating material body, the electric insulating material body includes a wall disposed on the second end surface so as to surround a position from which the heating wire leads out, wherein the wall is disposed around a perimeter of the second end surface, the second end surface surrounded by the wall rises in a dome shape, and the heating wire leads out from a position between the wall and a center of the second end surface.

23. A cathode structure comprising:

a heater including a columnar electric insulating material body and a heating wire that is partially buried and in contact with the electric insulating material body, wherein the heating wire is coiled, within the insulating material body, around a first axis; and a cathode unit is disposed at a first end surface of the electric insulating material body including a metal cup and a pellet member supported in the metal cup, the pellet member containing an electron-emitting material, wherein the heating wire leads out from a second end surface of the electric insulating material body and the first axis of the coiled heating wire is parallel to the first end surface of the electric insulating material to provide a compact configuration for the cathode structure with an enlarged heat transmitting capacity, the electric insulating body includes a wall disposed on the second end surface so as to surround a position from which the heating wire leads out;

wherein the wall is disposed around a perimeter of the second end surface, the second end surface surrounded by the wall rises in a dome shape, and the heating wire leads out from a position between the wall and a center of the second end surface.

24. A cathode structure comprising:

a heater including a columnar electric insulating material body having a diameter larger than a height and a heating wire that is partially buried and in contact with the electric insulating material body, wherein the heating wire is coiled, within the insulating material body, around a first axis; and a cathode unit is disposed at a first end surface of the electric insulating material body including a metal cup and a pellet member supported in the metal cup, the pellet member containing an electron-emitting material, wherein the heating wire leads out from a second end surface of the electric insulating material body and the first axis of the coiled heating wire is parallel to the first end surface of the electric insulating material to provide a compact configuration for the cathode structure with an enlarged heat transmitting capacity and the electric insulating material body is in a circular columnar shape, and includes a part that has a greater diameter than that of the second end surface.

* * * * *